US006121863A

United States Patent [19]

Hwang

[11] Patent Number: 6,121,863

[45] **Date of Patent: *Sep. 19, 2000**

[54] LATCHING RELAY HAVING A MANUAL RESET FUNCTION

[75] Inventor: Bar-Chung Hwang, Taoyuan, Taiwan

[73] Assignee: Winbond Electronics Corp., Hsinchu, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 08/870,945

[22] Filed: Jun. 6, 1997

[30] Foreign Application Priority Data

Mar. 7, 1997 [TW] Taiwan ..... 86203516

[51] Int. Cl.[7] ..... H01H 9/20

[52] U.S. Cl. ..... 335/166; 335/128; 335/89

[58] Field of Search ..... 335/78–89, 124, 335/128, 165, 166, 167–76, 185, 186, 177–87

[56] References Cited

U.S. PATENT DOCUMENTS

| | | | |
|---|---|---|---|
| 3,914,723 | 10/1975 | Goodbar | 335/78 |
| 3,925,742 | 12/1975 | Muench | 335/186 |
| 4,378,543 | 3/1983 | Melter et al. | 335/186 |

*Primary Examiner*—Lincoln Donovan
*Attorney, Agent, or Firm*—Ladas & Parry

[57] ABSTRACT

A latching relay having a manual reset function. The latching relay includes a coil for generating a magnetic force. An armature is provided which is dragged by the magnetic force to change into a first switching state of the armature. An elastic device which is moved following the movement of the armature caused by the magnetic force, is adapted to receive an external force to switch the armature back into a second switching state, wherein the armature can maintain one of the switching states without the magnetic force and the external force existing. A reset device is provided to receive the external force to move the elastic device, thereby switching the armature into the second switching state. A fixed support fixes in place the coil, armature and elastic device and provides a magnetic loop to strengthen the magnetic force.

5 Claims, 4 Drawing Sheets

LATCHING RELAY HAVING A MANUAL RESET FUNCTION

BACKGROUND OF THE INVENTION

1. Field of the Invention

The present invention relates to a latching relay, and, in particular, to a latching relay having a manual reset function.

2. Description of the Related Art

A latching relay of the prior art as shown in FIG. 1 includes switch 10 and coil 12. The on/off states of the latching relay are controlled by the current flowing through coil 12. Once the latching relay maintains an on or off stable state, the current flowing through coil 12 can be switched off until the state of the latching relay is required to change. However, when the latching relay employed for power control is in an off-state, resulting in a power down, the current can not flow through coil 12, whereupon the state of switch 10 can not be changed. At this point, the power can be temporarily supplied to coil 12 by using one-shot voltage control switch 14, such that the latching relay can be brought into an on-state.

Currently, the above-mentioned latching relay is widely used. However, since the latching relay can not be switched to an on-state in a power down situation, the latching relay can not be used in a wired telephone or power controller. Generally, the latching relay in a wired telephone is used to force a wired telephone into an on-hook (off-line) state. Since the power can not be provided to the coil after the telephone is on-hook, the latching relay can not be reset. Likewise, the same problem happens in the power controller. Thus there is typically an additional one-shot voltage control switch used to restart the power.

SUMMARY OF THE INVENTION

In view of the above, the invention provides a latching relay having a manual reset function which can be turned on again in order to bring the electric power back by a manual reset when the latching relay is off, thereby turning off electric power for the entire circuit. The latching relay having this manual reset function includes a coil for generating a magnetic force, a switch dragged by the magnetic force in order to switch the connection state thereof, and an elastic member switched to one of two different stable states and which maintains the stable state without an existing external force, a reset device pressed by hand or other mechanical movement, thereby providing an external force required for switching the elastic member into the other state, and a fixed support for fixing the coil, switch, and elastic member and providing a magnetic loop to generate a stronger magnetic force.

BRIEF DESCRIPTION OF THE DRAWINGS

The present invention will become more fully understood from the detailed description given hereinbelow and the accompanying drawings, which are provided for illustration of preferred embodiments only and should not be construed as limiting the scope of the present invention, and wherein.

In all figures mentioned above, the same elements or devices are marked with the same numeral.

DETAILED DESCRIPTION OF THE INVENTION

Figure 2A:
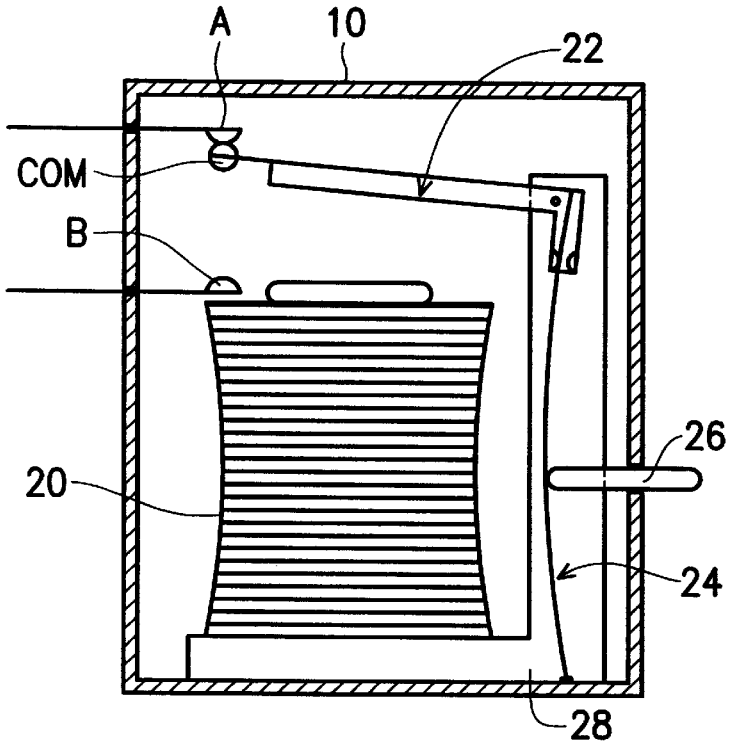
FIGS. 2*a*–2*b* are a schematic view illustrating the on/off states of a latching relay having a manual reset function according to a preferred embodiment of the invention.
Figure 2B:
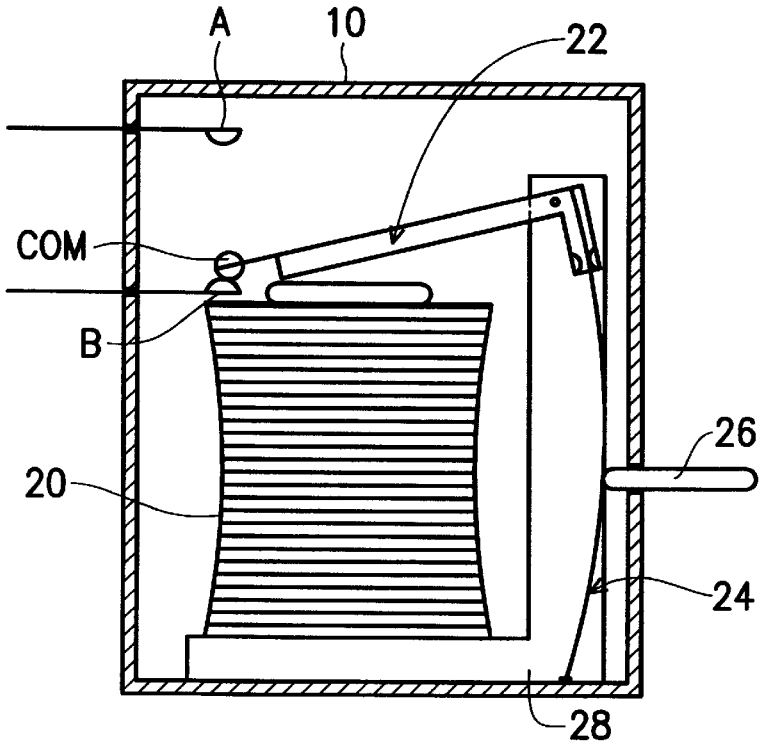

Referring to FIGS. 2*a* and 2*b*, a latching relay having a manual reset function is shown. Coil 20 generates a magnetic force. Armature 22 is dragged by the magnetic force generated by coil 20 to move the common point of switch 22 for switching the connection state thereof. Fragment 24 is moved due to the movement of the armature 22, thereby switching the Fragment 24 into a first switching state as shown in FIG. 2*b*, wherein the stable state can be maintained without the existing magnetic force. Reset button 26 provides an external force required to switch fragment 24 into a second switching state as shown in FIG. 2*a* by hand or other mechanical movements. Fixed support 28 fixes coil 20, armature 22, and latching fragment 24, as well as providing a magnetic loop to generate a stronger magnetic force.

The operation of the latching relay having a manual reset function will be more fully described hereinafter. When the latching relay is in a normal condition and reset button 26 is already depressed as shown in FIG. 2*a*, the common point of armature 22 is connected to Point A while Point B is disconnected from the common point COM. When a current is provided to coil 20, a magnetic force is generated, such that the common point departs from Point A and connects to Point B. The other end of armature 22 is a moving support which can drag latching fragment 24 to bend latching fragment 24 toward the other direction and reset button 26 is simultaneously pushed back, thereby reaching the other stable state as shown in FIG. 2*b*. Since latching fragment 24 can restrain armature 22, latching fragment 24 remains in the stable state, even though the current is removed from coil 20.

When no current flows through coil 20, pushing reset button 26 forces latching fragment 24 back to the original position, thereby moving the common point COM from point B to point A, so that the latching relay is brought into the original stable state as shown in FIG. 2*a*. At this point, the latching relay still maintains the state, even though reset button 26 is released.

Figure 3A:
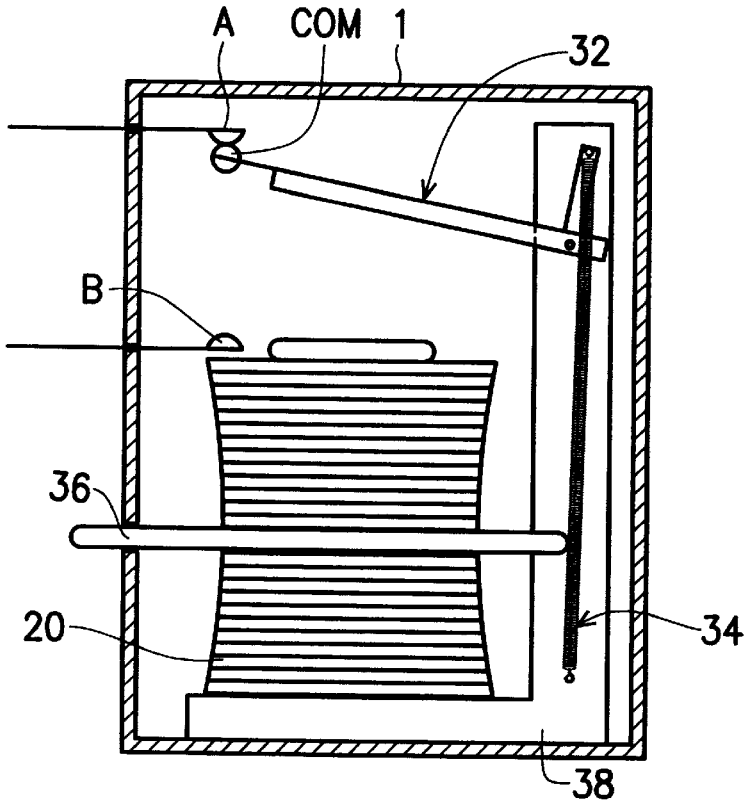
FIGS. 3*a*–3*b* are a schematic view illustrating the on/off states of a latching relay having a manual reset function according to another preferred embodiment of the invention.
Figure 3B:
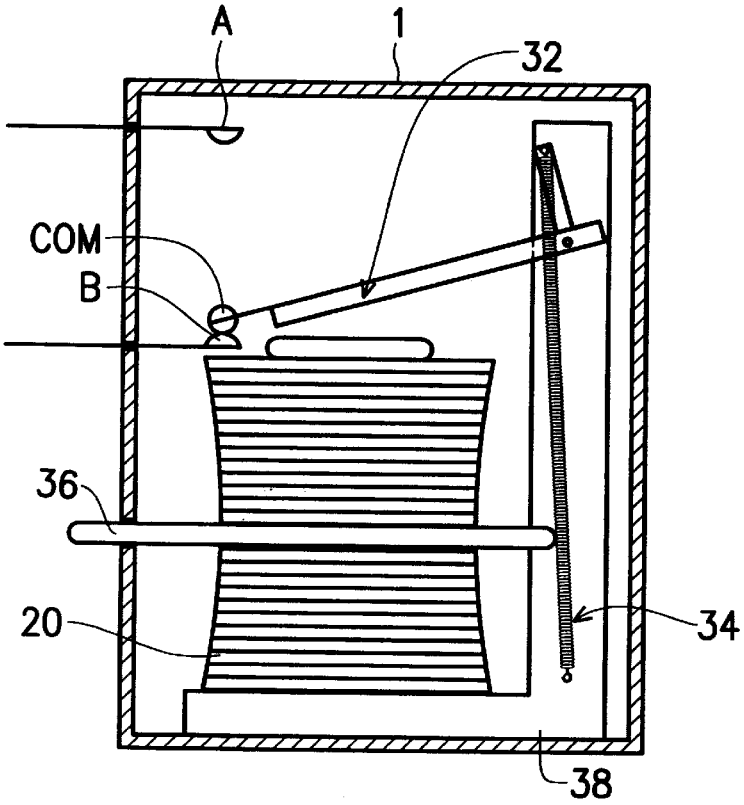

Referring to FIGS. 3*a* and 3*b*, a latching relay having a manual reset function according to another embodiment of the invention is shown. Coil 20 generates a magnetic force. Armature 32 is dragged by the magnetic force generated by coil 20 to move the common point of armature 32 for switching the connection state thereof. Spring 34 is moved due to the movement of the armature 22, thereby switching the spring 24 into a first switching state as shown in FIG. 3B, wherein the stable state can be maintained without the existing magnetic force. Reset button 36 provides an external force required to switch spring 34 into a second switching state as shown in FIG. 3*a* by hand or other mechanical actions. Fixed support 38 fixes coil 20, armature 32, and spring 34, as well as providing a magnetic loop to generate a stronger magnetic force. The difference between the present embodiment and the previously described is that reset button 36 is a cross bar which touches the spring directly. When the latching relay is in a stable state as shown in FIG. 3*b*, pushing reset button 36 applies pressure to spring 34 and causes the switch to return to the original state as shown in FIG. 3*a*.

The two embodiments mentioned above provide two different kinds of spring devices. In fact, various elastic devices, such as springs and fragments, having the latching function mentioned above, can also be used in the invention.

Furthermore, a single-throw switch can also be used in the above-mentioned embodiments instead of the double-throw switch, wherein the number of the switch blades can be one or more.

Figure 1:
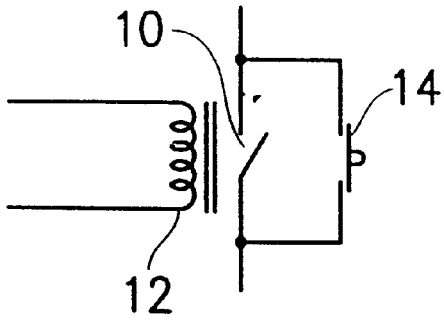
FIG. 1 (PRIOR ART)
FIG. 1 is a circuit diagram illustrating a latching relay according to the prior art.
Figure 4A:
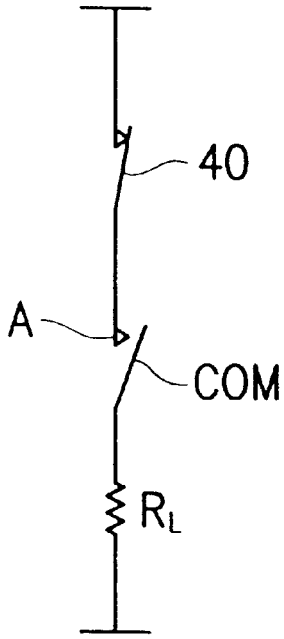
FIGS. 4*a*–*b* are a circuit diagram illustrating the relationship between a latching relay having a manual reset function and the hook of a telephone according to the invention.
Figure 4B:
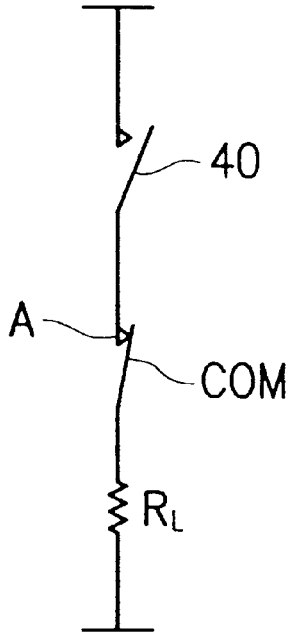

Next, the various applications of the invention will now be described with reference to FIGS. 4*a* and 4*b*. The latching relay having a manual reset function according to the present invention can serve as a forced on-hook latching relay in the telephone. As shown in FIG. 4*a*, when a hand set is picked up to close hook 40, a coil (not shown) can be driven by electric power in the telephone thereby disconnecting Point COM from Point A to achieve a forced on-hook. As shown in FIG. 4*b*, when the hand set is hung up to open hook 40, a reset device (not shown) connected to hook 40 is activated simultaneously to connect Point COM to Point A, thereby achieving the manual reset operation. Furthermore, hook 40, point COM of the latching relay and load resistor $R_L$ are connected in series. Similarly, Point COM and point A of the latching relay can also be employed in a power controller (not shown). The automatic control circuit can supply power to the coil of the latching relay to force Point COM and Point A into an on-state, thereby shutting down the power source and protecting the system security. When the user wants to restart the power system, just pushing the reset button can connect Point COM to Point A.

In addition, Point COM and Point A can also be used for a load requiring an automatic on/manual off function, for example, a prompt lamp or alarm lamp with a power saving function.

Figure 5:
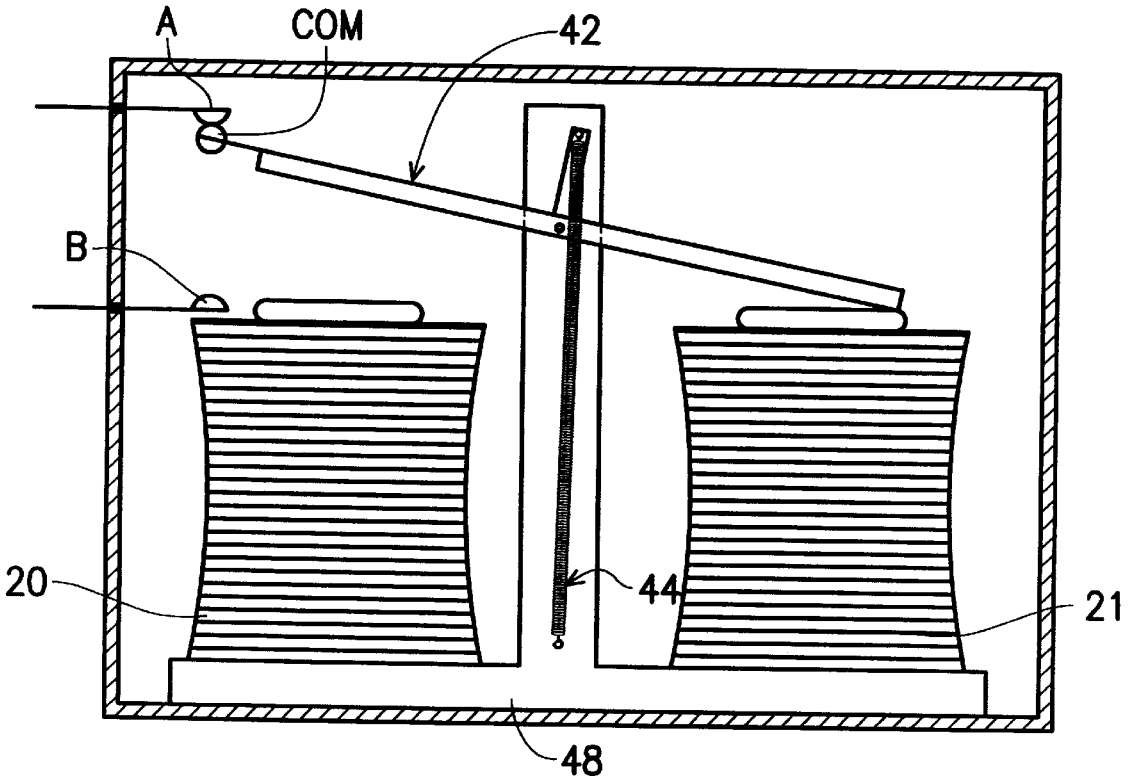
FIG. 5 is a schematic view illustrating the on/off states of a latching relay having a manual reset function according to yet another preferred embodiment of the invention.

As described above, the invention provides a manual reset function in order to switch the stable state of the latching relay when no power is applied. In addition to the manual button for achieving the reset operation, another coil able to generate a counter attractive magnetic force can also be added to achieve the reset operation by providing a current to the coil. This embodiment is shown in FIG. 5. Armature 42 removes Point COM in order to switch the connection state of armature 42. First coil 20 generates a magnetic force to armature switch 42 from a first state to a second state. Second coil 21 switches armature 42 from the second state to the first state. Furthermore, during the movement of armature 42, spring 44 can be switched into one of the two stable states. Fixed support 48 fixes coil 20 and 21, armature 42 and spring 44 and provides a magnetic loop to generate a stronger magnetic force. Moreover, the support connected to the switch can be changed to a magnet, and the coil and fixed support can be changed to a non-magnetic conductivity core. However, since either one of two opposite directions of currents can be added to the coil, thereby generating attractive and repulsive forces to achieve the reset operation, it is not necessary to use two coils at the same time.

What is claimed is:

1. A latching relay having a manual reset function, comprising:

a coil for generating a magnetic force when the coil is energized;

an armature which is attractable by said magnetic force to be displaced from a first position to a second position;

an elastic device coupled to the armature, the elasticity of the elastic device keeping the armature stable at both the first position or the second position in the absence of an external force;

a manually activated reset device providing the external force to move said elastic device to displace said armature from the second position to the first position; and a fixed support for supporting said coil, armature and elastic device and providing a magnetic loop to strengthen said magnetic force, the armature being pivotally connected with the fixed support.

2. The latching relay having a manual reset function as claimed in claim 1, wherein said elastic device is a latching fragment.

3. The latching relay having, a manual reset function as claimed in claim 1, wherein said elastic device is a spring providing biasing against the manually activated reset device.

4. The latching relay having a manual reset function as claimed in claim 1, wherein said manually activated reset device is a button and can be pushed so as to switch said armature to said second position.

5. A latching relay having a manual reset function comprising:

a coil for generating a magnetic force when the coil is energized;

an armature which is attractable by said magnetic force to be displaced from a first position to a second position;

an elastic device coupled to the armature, the elasticity of the elastic device keeping the armature stable at both the first position or the second position in the absence of an external force;

a manually activated reset device providing the external force to move said elastic device to displace said armature from the second position to the first position; and a fixed support for supporting said coil, armature and elastic device, the armature being pivotally connected with the fixed support, wherein said armature is made of magnetic conductivity material, and said coil is supplied with either one of two opposite directions of currents, thereby generating attractive forces between said coil and said armature.

* * * * *